United States Patent [19]

Hsiao

[11] Patent Number: 4,960,017

[45] Date of Patent: Oct. 2, 1990

[54] HAND TOOL FOR MOUNTING OR DISMOUNTING BICYCLE CRANKS

[76] Inventor: K. H. Hsiao, No. 4, Lane 11, Tzu Chiang St., Tu Cheng Shiang, Taipei Shien, Taiwan

[21] Appl. No.: 372,831

[22] Filed: Jun. 29, 1989

[51] Int. Cl.[5] ..... B25B 23/00

[52] U.S. Cl. ..... 81/459; 81/488

[58] Field of Search ..... 81/459, 437–439, 81/488, 53.2

*Primary Examiner*—D. S. Meislin

*Attorney, Agent, or Firm*—Bacon & Thomas

[57] ABSTRACT

This invention is related to a hand tool specifically designed for operation to mount or remove a bicycle crank to or from the bolted bottom bracket bearing axle of a bicycle frame, which includes a tool handle having a front wedge to serve as a driver, a screw bolt having one end fixedly connected with a socket and having the other end movably connected with a bolted sleeve by means of screw joint. Through the arrangement of the said component parts, the hand tool is very practical for dismounting the fastening elements of bicycle cranks.

2 Claims, 6 Drawing Sheets

HAND TOOL FOR MOUNTING OR DISMOUNTING BICYCLE CRANKS

BACKGROUND OF THE INVENTION

The present invention is related to a kind of hand tool specifically designed for mounting or dismounting bicycle cranks onto or from a bicycle, and more particularly to a hand tool having numerous features for efficiently mounting or removing bicycle cranks.

In recent years, because of fast economic develoment, the use of a bicycle has changed from being original transportation to a kind of recreational and sporting activity. In order to meet the actual demand and the interest users, simple maintenance and repair work, which heretofore required professional assistance, has now become a common practice among bicycle owners.

Through a long history of development, the bicycle has now become a very matured product. The component parts used in a bicycle are normally standardized. However, in maintenance and repair work, several hand tools may be required for mounting or dismounting respective fastening elements. Therefore, it is not convenient to carry or to operate several hand tools at a time.

The scope of the present invention is to combine several hand tool into one consolidated unit for convenient transport and operation. The present invention may be fully understood from the following detailed description of the preferred embodiments considered in connection with the annexed drawings.

BRIEF DESCRIPTION OF THE DRAWINGS

FIG. 2 is an exploded perspective hand tool view of the;

DETAILED DESCRIPTION OF THE PREFERRED EMBODIMENTS

Figure 1:
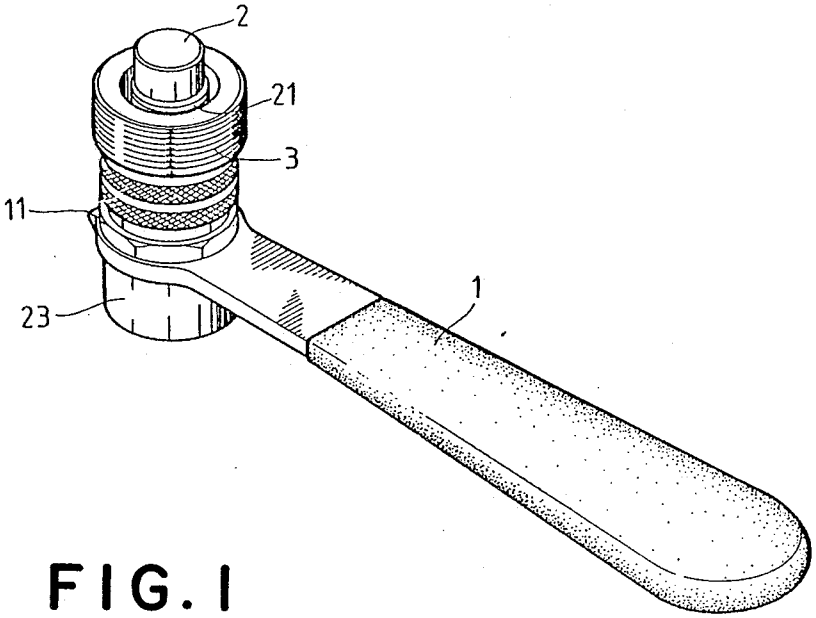
FIG. 1 is a perspective view of hand tool according to the present invention.
Figure 2:
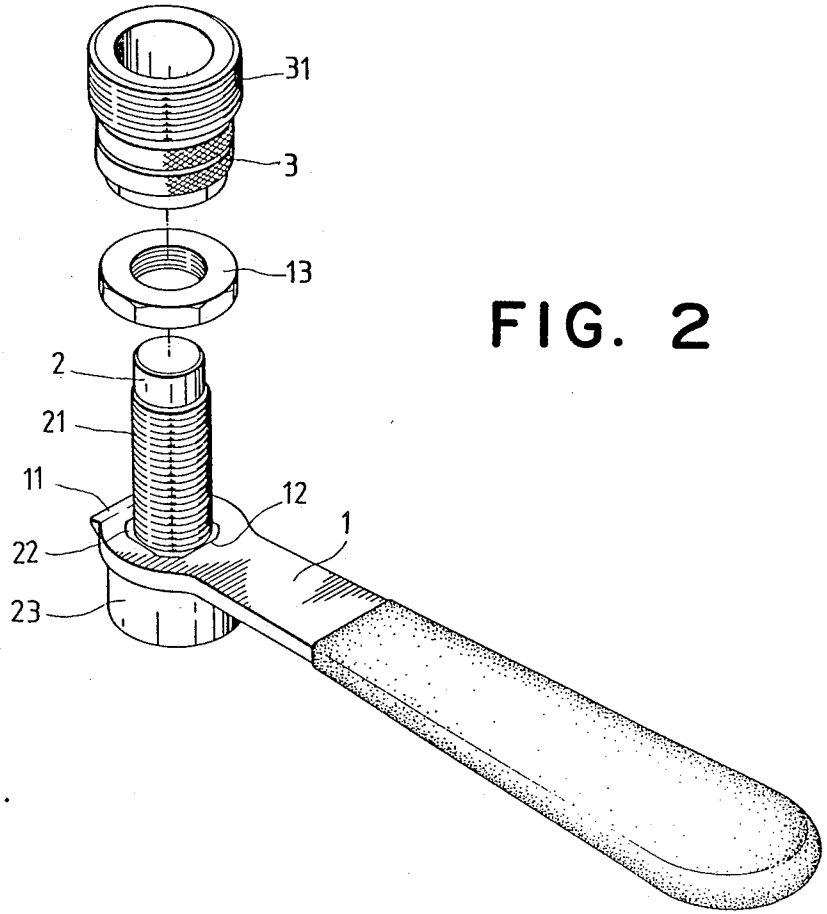

Turning now to the drawings in greater detail and considering first FIG. 1 there is shown an embodiment of a hand tool for mounting or dismounting bicycle cranks, which tool includes a handle (1) having a front wedge (11) integrally formed at the front end and a square hole (12) extending vertically through the front end near the front wedge (11) for setting therein of a screw bolt (2), which screw bolt (2) comprises an outer threaded portion (21), a socket (23) secured at one end of bolt (2) and provided with a hexagonal hole (24) therein. The screw bolt (2) also includes a square-shaped non-threaded portion (22) which is set in the square hole (12) of the handle (1). When the screw bolt (2) is inserted into the square hole (12) of the handle (1), it is secured to the handle (1) by means of a screw nut (13) with its outer thread portion (21) extending beyond the handle (1) for rotatably mounting a sleeve (3) by means of screw joint, which sleeve (3) is also provided with an outer thread (31) thereon.

Figure 3:
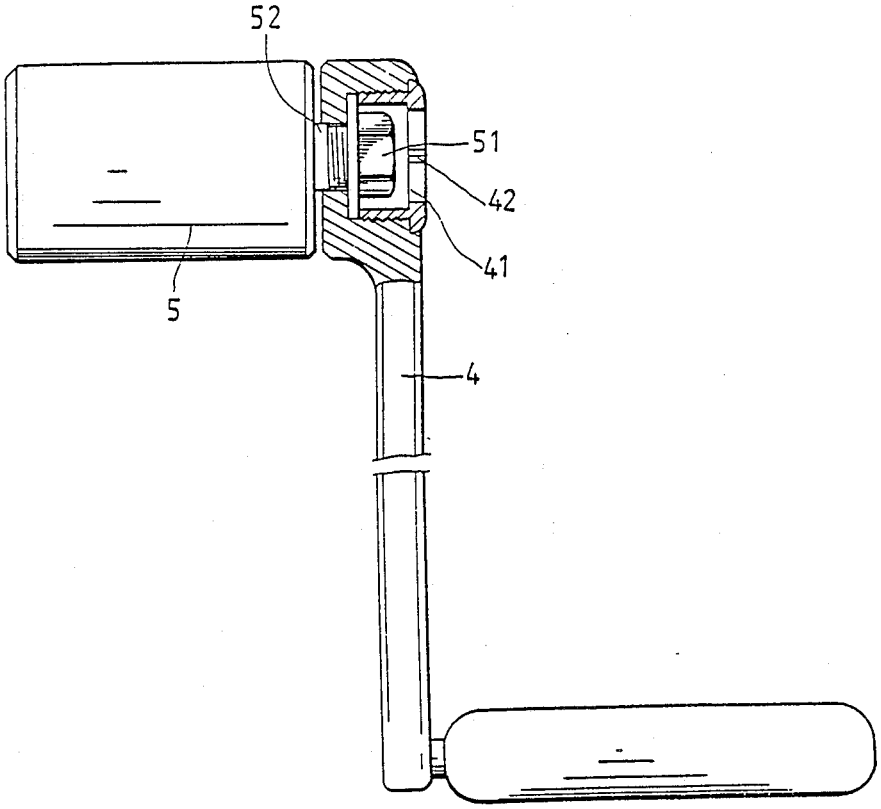
FIG. 3 is a side elevation of a conventional bicycle crank structure.

With reference to FIG. 3, a conventional bicycle crank (4) includes a pivot hole (not shown) to mount on a bolted bottom bracket bearing axle (52) of a bicycle frame (5). The crank (4) is further slid onto the bolted bottom bracket bearing axle (52) and secured in place by a screw nut (51). In order to provide an attractive outer appearance, the outer end of the pivot hole of the crank (4) is fixed up with a lock nut (41) which engages on inner thread (53) of the crank (4) and includes a notch (42) formed thereon.

Figure 4A:
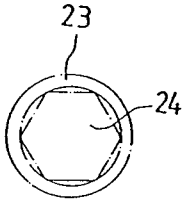
FIG. 4 is a side elevation, illustrating the operation of the present invention to remove a bicycle crank.
Figure 4:
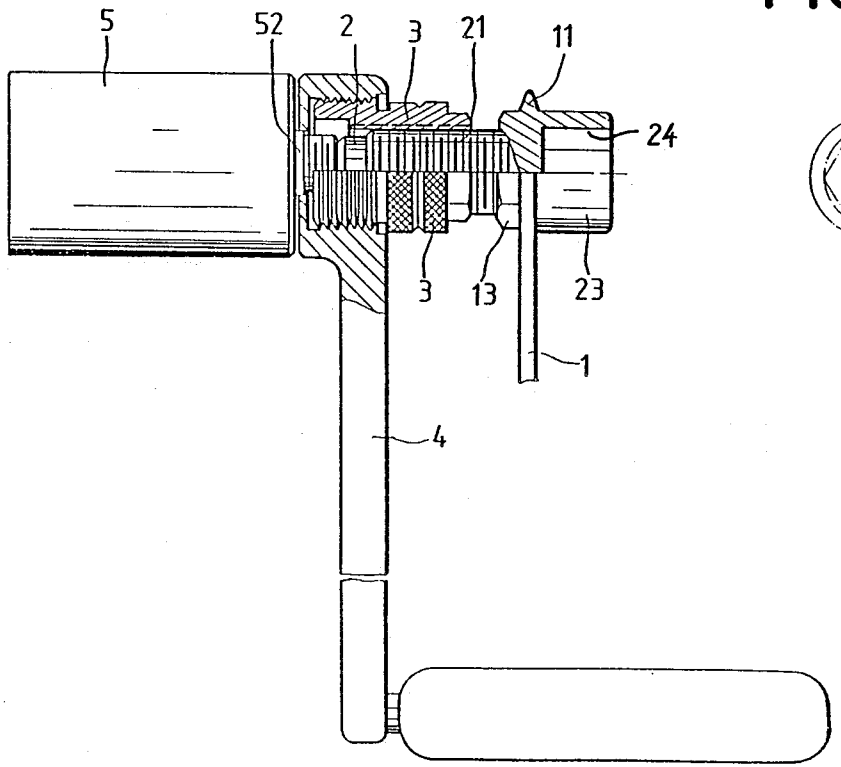
Figure 5:
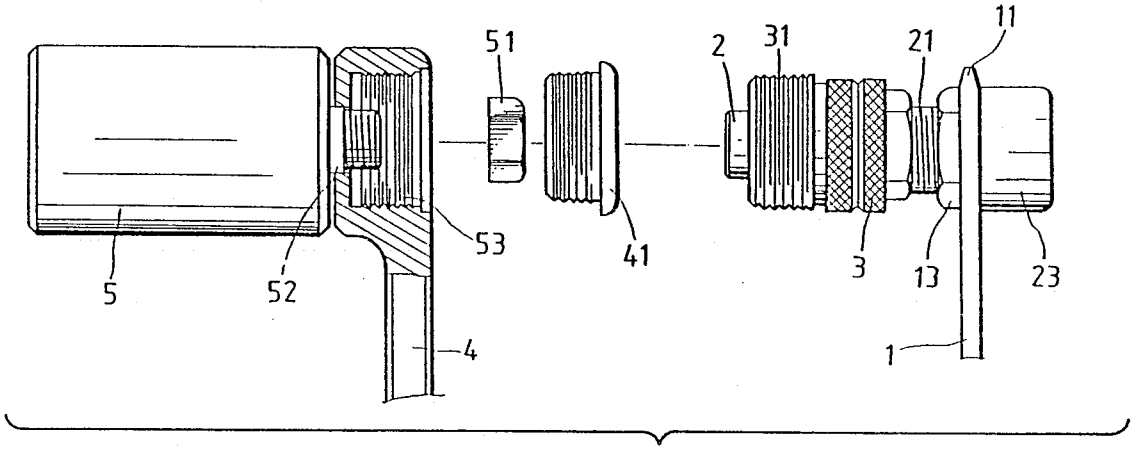
FIG. 5 is a partial exploded view of the assembly shown in FIG. 4 and depicting both the lock and screw nuts removed from the crank structure.
Figure 6:
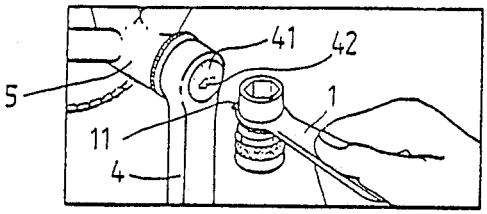
FIG. 6–8 depict the sequential steps of using the hand tool to remove the lock nut, the screw nut, and the crank from the bearing axle.
Figure 7:
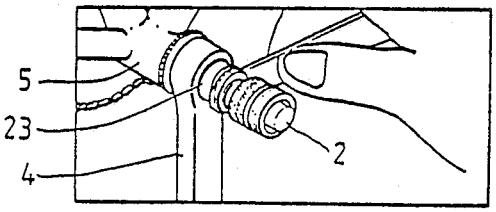
Figure 8:
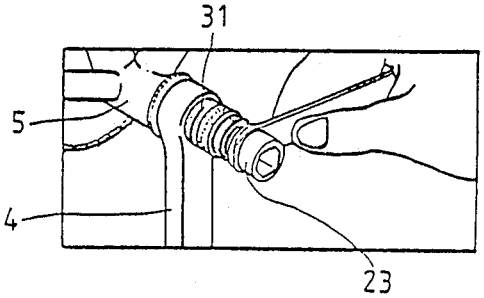

The main object of the present invention is to efficiently mount the crank (4) to the bottom bracket bearing axle (52) of the bicycle frame (5) and to efficiently remove the crank (4) therefrom. When in operation to remove the crack (4) from the bolted bottom bracket bearing axle (52) of bicycle frame (5), the front wedge (11) of the handle (1) is engaged in the notch (42) of the lock nut (41) and rotated to loosen the lock nut (41). Then, the socket (23) of the handle (1) is set into the pivot hole of the crank (4) to engage the screw nut (51) and remove some from the bolted bottom bracket bearing axle (52). The handle (1) is then reversed to permit engagement of outer thread (31) of the sleeve (3) with the inner thread (53) of the crank (4). Because the sleeve (3) is freely rotatable on the screw bolt (21) of the handle (1), when the sleeve (3) is threadedly engaged with the crank (4), continued rotation of the handle (1) causes screw bolt (21) to be gradually driven toward the bolted bottom bracket bearing axle (52), as shown in FIG. 4 because of a threaded connection between sleeve (3) and screw bolt (21). As soon as the screw bolt (21) is stopped against the bolted bottom bracket bearing axle (52), further rotation of the handle (1) causes the crank (4) to break away from the bolted bottom bracket bearing axle (52). In order to mount the crank (4) onto the bolted bottom bracket bearing axle (52), the above procedure is reversed.

As described above, the present invention provides a hand tool for mounting and dismounting bicycle cranks in a most efficient manner.

What is claimed is:

1. A hand tool for mounting or dismounting a bicycle crank comprising:

(a) a handle including a front end;

(b) a wedge extending from the front end for engaging the notch of a bicycle crank lock nut;

(c) a square-shaped hole extending through the front end;

(d) a bolt including a hexagonal-shaped socket at one end, a threaded portion and a square portion positioned between the socket and threaded portion, the square portion being engageable within the square-shaped hole of the front end; and (e) a sleeve rotatably mounted on the threaded portion of the bolt and including an outer threaded portion for threaded engagement with the inner thread of a bicycle crank.

2. The hand tool of claim 1 including a threaded nut for engaging the threaded portion of the bolt to secure the bolt to the front end of the handle.

* * * * *